US006051922A

United States Patent [19]

Schlejen et al.

[11] Patent Number: 6,051,922

[45] Date of Patent: Apr. 18, 2000

[54] ELECTRODELESS LOW-PRESSURE MERCURY VAPOUR DISCHARGE LAMP EMPLOYING A HIGH FREQUENCY MAGNETIC FIELD HAVING A LAYER OF ALUMINUM OXIDE PARTICLES

[75] Inventors: Jakob Schlejen, Morgantown, W. Va.; Johannes J. M. Buck; Christianus J. Roozekrans, both of Eindhoven, Netherlands

[73] Assignee: U.S. Philips Corporation, New York, N.Y.

[21] Appl. No.: 08/999,972

[22] Filed: Feb. 3, 1997

Related U.S. Application Data

[63] Continuation of application No. 08/410,021, Mar. 24, 1995, abandoned.

[30] Foreign Application Priority Data

Mar. 25, 1994 [EP] European Pat. Off. ..... 94200806

[51] Int. Cl.[7] ..... H01J 1/62

[52] U.S. Cl. ..... 313/489; 313/161

[58] Field of Search ..... 313/161, 234, 313/489, 493, 607, 635; 315/248, 344

[56] References Cited

U.S. PATENT DOCUMENTS

| | | | |
|---|---|---|---|
| 3,886,396 | 5/1975 | Hammer et al. | 313/489 |
| 4,079,288 | 3/1978 | Maloney et al. | 313/489 |
| 4,117,378 | 9/1978 | Glascock, Jr. | 315/248 |
| 4,639,637 | 1/1987 | Taubner et al. | 313/489 |
| 4,922,157 | 5/1990 | Van Engen et al. | 315/248 |
| 4,927,217 | 5/1990 | Kroes et al. | 315/248 |
| 5,148,085 | 9/1992 | Kroes | 315/248 |

FOREIGN PATENT DOCUMENTS 0162504 11/1985 European Pat. Off. .

OTHER PUBLICATIONS

"New Insights in Chromaticity and Tolerance Areas of Fluorescent lamps", by J.J. Opstelten et al, Journal of Illuminating Engineering Society, Winter 1987, pp. 117–127.

*Primary Examiner*—Jay Patidar
*Attorney, Agent, or Firm*—F. Brice Faller

[57] ABSTRACT

An electrodeless low-pressure mercury vapor discharge lamp includes a discharge vessel that gas-tightly encloses a discharge-space that is provided with a fill of mercury and a noble gas. The discharge vessel has a light-transmitting enveloping part and further has a sunken part in which a coil for generating a high-frequency magnetic field is arranged. At least a portion of a surface of the discharge vessel turned towards the discharge space is provided with a luminescent layer. At least a portion of the luminescent layer bears a protective layer of aluminum oxide particles with a covering weight of 10 to 500 $\mu g/cm^2$. The protective layer provides for a lower mercury consumption and/or a reduction in the change of colour point during lamp life.

1 Claim, 3 Drawing Sheets

ELECTRODELESS LOW-PRESSURE MERCURY VAPOUR DISCHARGE LAMP EMPLOYING A HIGH FREQUENCY MAGNETIC FIELD HAVING A LAYER OF ALUMINUM OXIDE PARTICLES

This is a continuation of application Ser. No. 08/410,021, filed Mar. 24, 1995, now abandoned.

BACKGROUND OF THE INVENTION

The invention relates to an electrodeless low-pressure mercury vapour discharge lamp with a discharge vessel which encloses a discharge space provided with a filling of mercury and rare gas in a gastight manner, which discharge vessel comprises a light-transmitting enveloping portion and in addition a recessed portion in which a coil for generating a high-frequency magnetic field is enclosed, and which discharge vessel is provided with a luminescent layer at least on a portion of a surface facing towards the discharge space.

Such a lamp is known from EP 0.162.504 B1 (Houkes et al. U.S. Pat. No. 4,710,678). The lamp is operated in that the coil is connected to a high-frequency electric supply source. The magnetic field generated by the coil induces an electric discharge in the discharge space. The coil in addition generates a comparatively strong electric field in the discharge space as a result of potential differences across this coil. The electric field strength may be very great especially near the recessed portion of the discharge vessel. In addition, comparatively high temperatures prevail in the wall of the discharge vessel. The temperature of the recessed portion may even assume values above 200° C.

Under these circumstances, luminescent materials present in the luminescent layer may react with particles from the discharge space which collide with these materials. Depending on the application of the lamp, this may give rise to disadvantages.

Usually, several kinds of luminescent materials are present in the luminescent layer, and the luminous efficacies of these materials are affected by the reactions with the particles to different degrees. The result of this is that the colour point of the light generated by the luminescent layer shows a shift during lamp life. This is no disadvantage when a single lamp is used because this process takes place gradually. Even a comparatively great difference with the colour point at the beginning of lamp life is not observable in that case. Clear differences in colour point, however, are observable in applications where known lamps of mutually differing ages are positioned in one and the same space. If one of the lamps is defective, it is necessary to replace not only the defective lamp, but also the other lamps in said space in order to avoid colour point differences under these circumstances, which is expensive. It was found that differences between colour points are observable when at least one of the colour points is present outside the Von Kries transformed MacAdam ellipse of another colour point (see: New Insights in Chromaticity and Tolerance Areas of Fluorescent Lamps, J. J. Opstelten and G. Rinzema, Journal of the IES, Winter 1987, pp. 117–127). This is the case if there is no ellipse half the size of the transformed MacAdam ellipse which comprises all colour points.

It was found to be favourable to operate the lamp of the kind mentioned in the opening paragraph by means of a pulsatory supply. The lumen output of the lamp may be adjusted between, for example, 10% and 100% of its rated lumen output in this mode of operation in that the ratio of the pulse duration to the time interval between the pulses is varied. In this mode of operation, however, comparatively high voltages are required for re-igniting the lamp at the start of each pulse. Electric fields will then occur, especially near the recessed portion, which are even stronger than those during nominal operation. It was found that mercury is bound to material in the luminescent layer under these circumstances, which mercury is no longer available for lamp operation. A comparatively large quantity of mercury is necessary if a sufficiently long lamp life is to be guaranteed in spite of this. This is bad for the environment in the case of inexpert disposal at the end of lamp life.

SUMMARY OF THE INVENTION

The invention has for its object to counteract the interaction between the luminescent layer and particles from the discharge space.

The electrodeless low-pressure mercury vapour discharge lamp according to the invention is for this purpose characterized in that at least a portion of the luminescent layer bears a protective layer of aluminium oxide particles with a coating weight of 10 to 500 $\mu g/cm^2$. It was surprisingly found that this measure counteracts the interaction between the luminescent layer and particles from the discharge space in spite of the comparatively strong electric fields and the comparatively high temperatures prevalent in the lamp.

A second attractive embodiment is characterized in that the surface of the enveloping portion facing towards the discharge space is provided with a luminescent layer bearing a protective layer having a coating weight of 10 to 50 $\mu g/cm^2$. Lamps according to this embodiment of the invention have the advantage that the colour point shift is so small that no difference is perceivable between the colour points of lamps of the same embodiment but differing in age. The recessed portion may be provided, for example, with a reflecting layer. In a modification, the recessed portion is also provided with a luminescent layer. It was found in this modification of the second embodiment that the colour point shift is also very small without a protective layer on the luminescent layer of the recessed portion. It is favourable, if in this second modification the luminescent layer on the recessed portion also bears a protective layer corresponding to that of the first embodiment in this modification. The lamp is then also suitable for pulsatory operation.

The protective layer may be readily provided in the form of a suspension of aluminium oxide powder, after which the layer is sintered, i.e. is heated for some time in order to drive out auxiliary substances such as binders from the layer. The suspension is applied to the surface, for example, by spraying. For providing the protective layer on the recessed portion, it may suffice to immerse the recessed portion in the suspension. Alternatively, the layer may be provided, for example, through electrostatic coating.

It is found in practice that lamp characteristics of electrodeless lamps, such as the lumen output or the change therein during lamp life, depend on the production location of the lamp.

It was surprisingly found with the lamp according to the invention that the change in lumen output depends much less on the production location than with the lamp not according to the invention. The measure according to the invention thus improves the reproducibility of said lamp characteristic in the case of manufacture in different locations.

DESCRIPTION OF THE PREFERRED EMBODIMENTS

Figure 1:
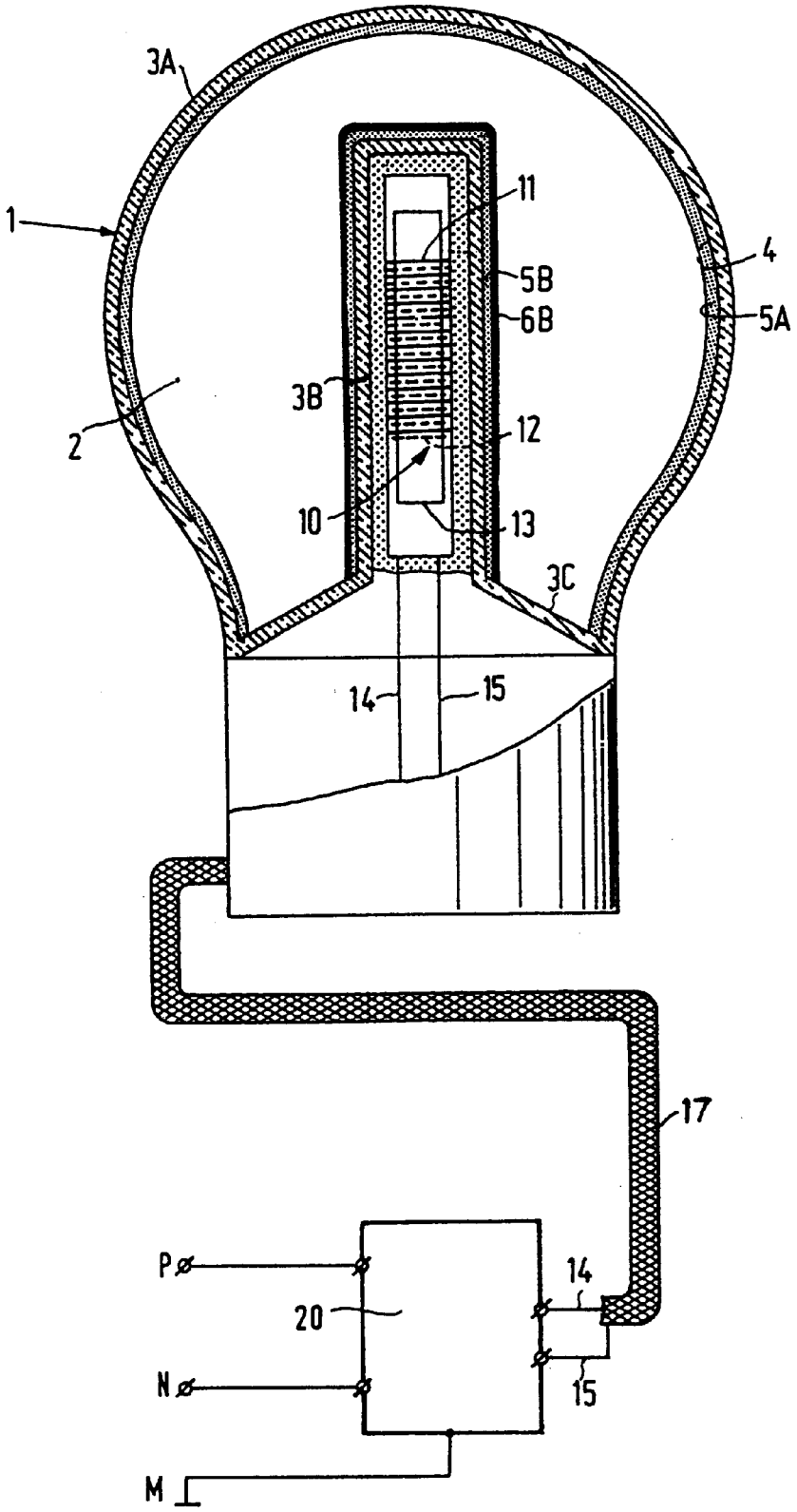
FIGS. 1 and 2 of the drawing show respectively, partly in side elevation and partly in a longitudinal sectional view, embodiments of discharge lamps of the invention as well as, diagrammatically, a supply device for the lamps.

Embodiments of the electrodeless low-pressure mercury vapour discharge lamp according to the invention are explained in more detail with reference to the drawings, in which:

The embodiment of the electrodeless low-pressure mercury vapour discharge lamp according to the invention shown in FIG. 1 is provided with a pear-shaped, gastight discharge vessel 1 which encloses a discharge space 2. The discharge vessel 1 has a light-transmitting enveloping portion 3A and a tubular, recessed portion 3B. The discharge vessel 1 further has a flanged portion 3C which connects the recessed portion 3B to the enveloping portion 3A. The discharge space 2 is provided with a filling of mercury and a rare gas, here argon. A coil 10 for generating a high-frequency magnetic field is accommodated in the recessed portion 3B. The coil 10 has a length of 25 mm and is provided with a first and a second winding 11, 12, each of 15 turns around a core 13 of soft-magnetic material. In an alternative embodiment, the coil may have, for example, an air core, or a core of ceramic material. The first winding 11 is connected to a high-frequency supply source 20 by means of current supply conductors 14, 15, enveloped by shield cable 17 in order to operate the lamp. The supply source 20 here has a frequency of 2.65 MHz. The second winding 12 has an end which is connected to current supply conductor 15 and also has a further, free end. The supply source 20 is connected to poles P and N of the mains and is earthed at pole M. The recessed portion 3B of the discharge vessel 1 is provided with a luminescent layer 5B at its surface facing towards the discharge space 2, this layer comprising red-luminescing yttrium oxide activated by trivalent europium (YOX) and green-luminescing cerium-magnesium aluminate activated by trivalent terbium (CAT). The luminescent layer 5B has a coating weight of 8 mg/cm$^2$. A surface 4 of the enveloping portion 3A facing towards the discharge space 2 is provided with a luminescent layer 5A which comprises blue-luminescing barium-magnesium aluminate activated by bivalent europium (BAM) in addition to the luminescent materials YOX and CAT. This luminescent layer 5A has a coating weight of 3.5 mg/cm$^2$.

The luminescent layer 5*b* on the surface 4 of the recessed portion 3B facing towards the discharge space 2 bears a protective layer 6B of aluminium oxide particles. The protective layer 6B was obtained in this case in that the recessed portion 3B was immersed in a suspension of Alon-C of the Degussa company, after which the layer remaining on the recessed portion 3B was dried and then sintered. The coating weight depends on the concentration of the aluminium oxide powder present in the suspension. Aluminium oxide powder of the Alon-C type comprises aluminium oxide particles with a size of approximately 0.01 to 0.04 $\mu$m, and has a specific area of approximately 100 m$^2$/g.

Lamps corresponding to the embodiment shown in FIG. 1 and having a coating weight of 170 $\mu$g/cm$^2$, of 250 $\mu$g/cm$^2$, and of 300 gcm$^2$ were manufactured, two of each kind. The coating weights of the lamps accordingly lay between the limits of 100 and 500 $\mu$g/cm$^2$. Two reference lamps were also manufactured in which a protective layer of aluminium oxide particles on the luminescent layer of the recessed portion was absent. The six lamps according to the invention and the two reference lamps were subjected to an endurance test of approximately 170 hours in order to assess the influence of strong electric fields of the kind which may arise during re-ignition. Each lamp was provided with a coil whose windings were interrupted for this purpose. The windings jointly extend over a length of 30.5 mm around the coil core. The interruption in the coil creates two coil parts each of 7.5 turns, approximately 5 mm spaced apart. A voltage of 700 V was applied to this coil during the endurance test. Since the coil is interrupted, it does not generate a magnetic field, so that no arc discharge is generated in the discharge vessel. The lamp accordingly remains permanently in a condition corresponding to that during re-ignition in reduced operation during the endurance test. In reduced operation of the lamp, the comparatively high re-ignition voltages occur during a fraction of each cycle only. This is because, on the one hand, a voltage is applied to the coil during a portion of each cycle only in this mode of operation, and on the other hand because the voltage across the coil drops quickly after lamp re-ignition. It is assumed that the above endurance test of 170 hours is comparable to approximately 5000 hours of pulsatory operation with a lamp power which is reduced to 15%.

A strong blackening of the luminescent layer between the coil parts was observed in the reference lamps after this endurance test. In the lamps according to the invention having a coating weight of 170 and 250 $\mu$g/cm$^2$, the luminescent layer was much less strongly discolored. A discoloration was even substantially absent in the lamps according to the invention having a coating weight of 300 $\mu$g/cm$^2$.

An electrodeless lamp was manufactured for comparison whose recessed portion was provided with a luminescent layer coated with a silicon oxide layer and one whose luminescent layer on the recessed portion was coated with an yttrium oxide layer. The lamps were also subjected to an endurance test. After no more than 16 hours of operation at a voltage of 600 V, the lamp with the yttrium oxide layer exhibited a pale brown band between the coil parts. The section of the recessed portion lying between the coil parts in the lamp having the silicon oxide layer remained unchanged in colour. The recessed portion, however, did show a grey discoloration on either side thereof.

It was also investigated, after the endurance test had been completed, to what extent mercury was bound to the luminescent material in the lamps according to the invention and in the reference lamps. For that purpose, the section of the recessed portion situated between the coil parts was subjected to a wet chemical analysis.

The average quantity of mercury bound to the luminescent material in the reference lamps (REF) and the respective average quantities in the lamps having a coating weight of 170, 250 and 300 $\mu$g/cm$^2$ of aluminum oxide are listed in the following Table.

| coating weight ($\mu$g/cm$^2$) | $m_{Hg}$ ($\mu$g) |
|---|---|
| REF | 62 |
| 170 | 33 |
| 250 | 30 |
| 300 | 18 |

It is evident from the Table that the quantity of bound mercury in the lamps according to the invention with a protective layer having a coating weight of 170 and 250 $\mu g/cm^2$ is approximately half that of the reference lamps. The quantity of bound mercury is even about one third in the lamp according to the invention whose protective layer has a coating weight of 300 $\mu g/cm^2$.

The drift in the lumen output between 1 and 100 hours of operation was measured for 10 lamps according to the invention whose luminescent layers on the recessed portions were coated with a protective layer of aluminium oxide particles, and for 10 lamps not according to the invention. The lamps not according to the invention correspond to those according to the invention except for the absence of a protective layer. Five of the lamps according to the invention were manufactured in a first production location (A), and five in a second production location (B). Similarly, five of the lamps not according to the invention were manufactured in the first production location (A) and five in the second production location (B).

The drift in the lumen output in the period from 1 to 100 hours of operation is shown in the following Table.

| | Lamp not according to the invention | Lamp according to the invention |
|---|---|---|
| A | 98.2% | 98.3% |
| B | 93.7% | 95.7% |
| difference | 4.5% | 2.6% |

Manufacture in different production locations leads to a difference in the lumen output drift of 4.5% in the lamps not according to the invention. This difference is no more than 2.6% in the lamps according to the invention.

Figure 2:
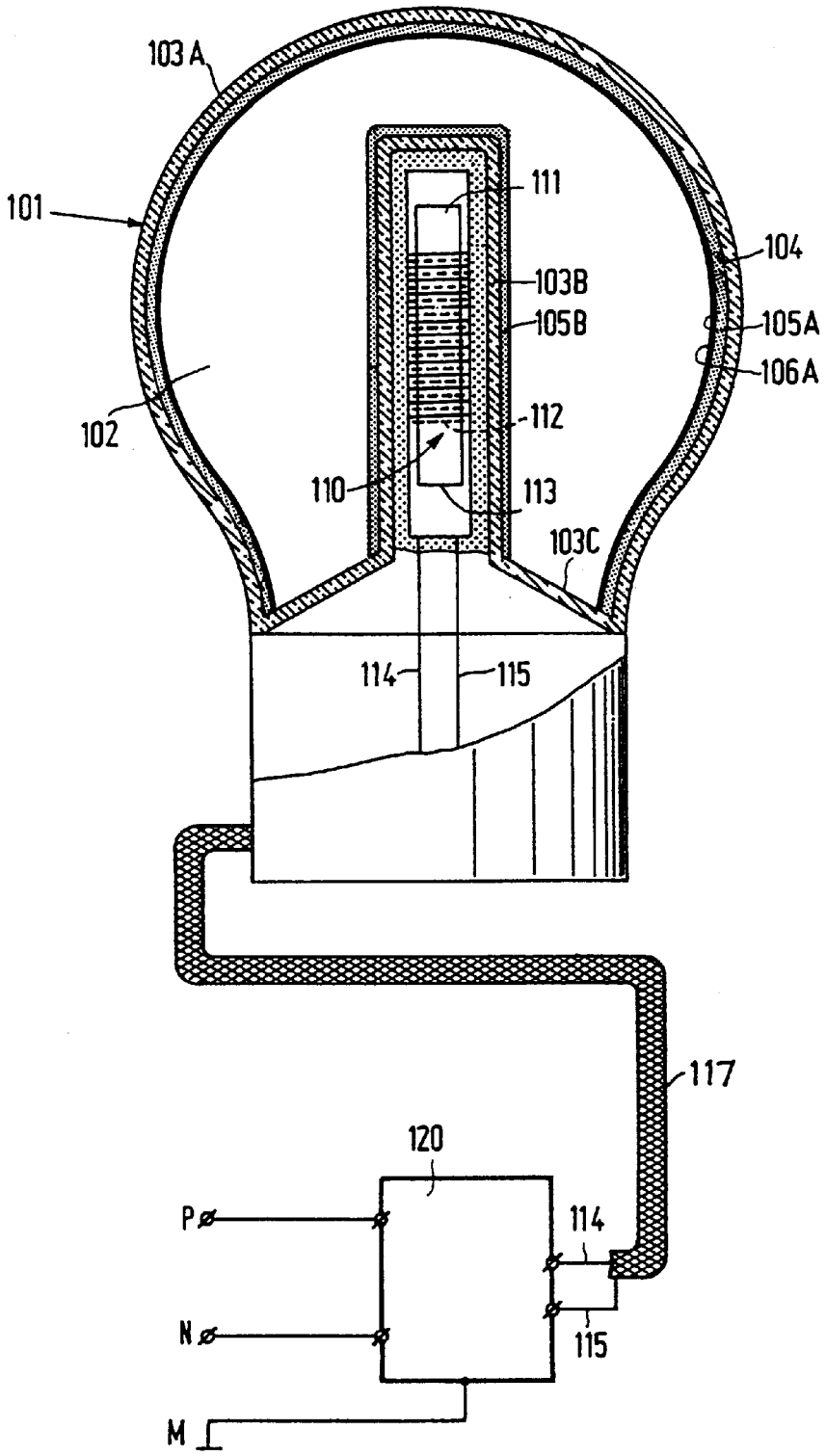

In FIG. 2, parts corresponding to those of FIG. 1 have reference numerals which are 100 higher. In the embodiment of the electrodeless low-pressure mercury vapour discharge lamp according to the invention shown here, the surface 104 of the enveloping portion 103A facing the discharge space 102 is provided with a luminescent layer 105A which bears a protective layer 106A with a coating weight of 28 $\mu g/cm^2$. The coating weight accordingly lies within the limits of 10 and 50 $\mu g/cm^2$.

In the embodiment shown, the flanged portion 103C has neither a luminescent nor a protective layer. In a modification, this portion 103C also has a luminescent layer, possibly be provided with a protective layer.

Six lamps were manufactured corresponding to the embodiment of the invention described with reference to FIG. 2. In addition, five reference lamps were manufactured without a protective layer of aluminium oxide particles on the luminescent layer of the enveloping portion 103A.

Figure 3:
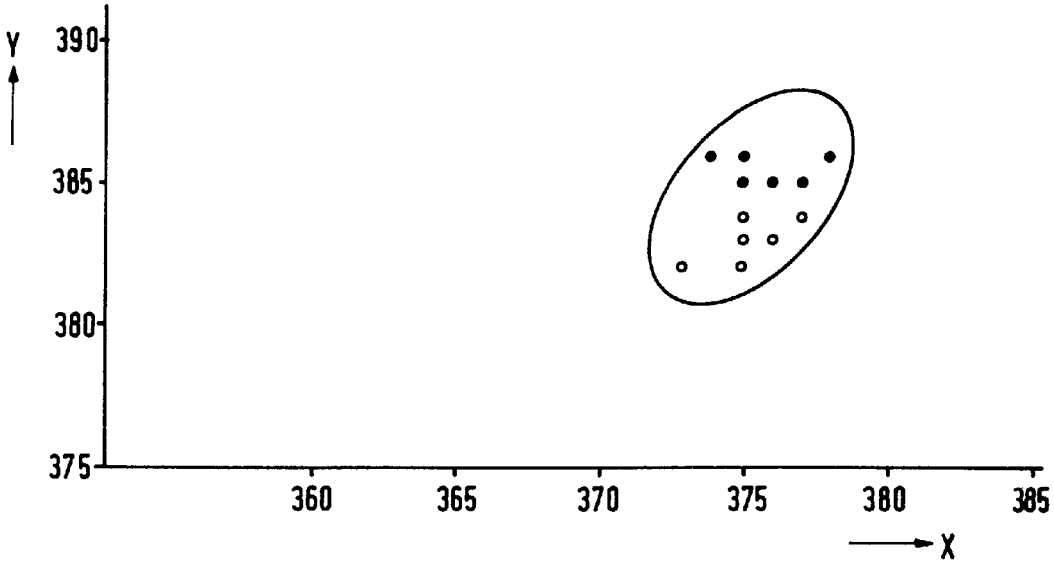
FIGS. 3 and 4 of the drawing are graphs showing the color point shift of lamps according to one of these embodiments and of known lamps, respectively.
Figure 4:
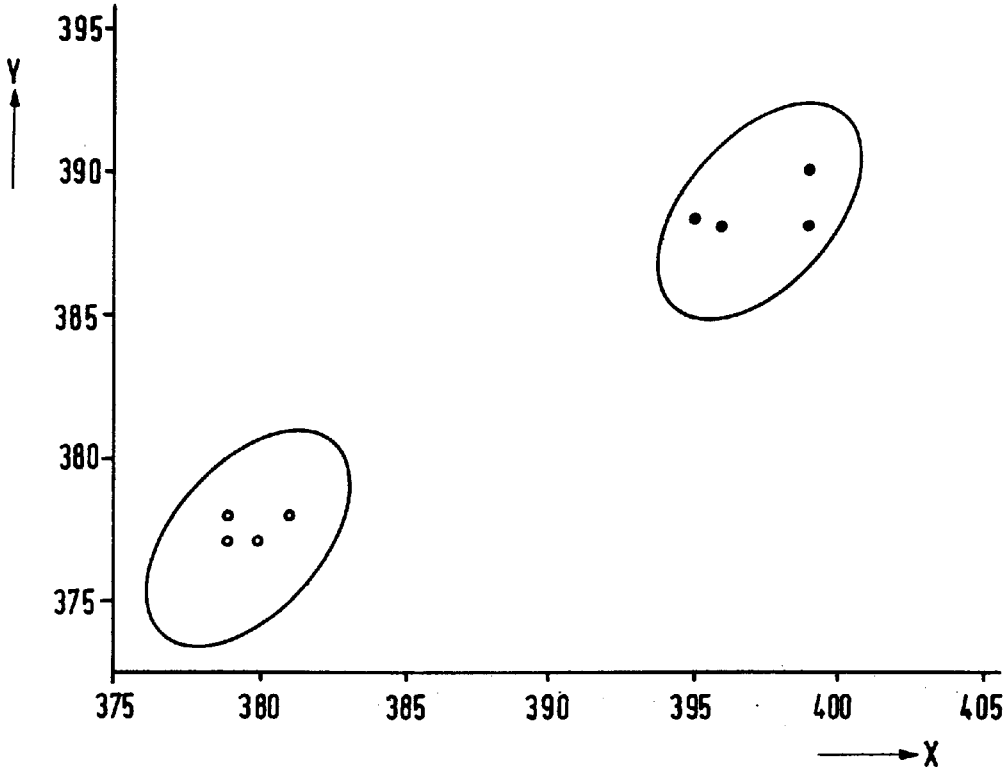

The above 11 lamps were subjected to an endurance test. The lamps were switched off for half an hour after 2.5 hours of operation each time during this. The x- and y-coordinates of the colour point were measured for the lamps both at the start and after 2000 hours of operation. FIG. 3 shows the colour points at the beginning (open dots) and after completion of the endurance test (closed dots) for the six lamps according to the invention. FIG. 4 shows the colour points of the five lamps which do not have a protective layer of aluminium oxide particles on the enveloping portion. In these Figures, the colour points at the beginning of lamp life are indicated with open dots and those at the end of lamp life with closed dots. Only four colour points are visible in FIG. 4 because two colour points had equal coordinates both at the beginning and at the end of the endurance test.

It is evident from FIG. 3 that the colour points of the lamps measured at the start and after completion of the endurance test lie jointly within an ellipse having half the size of a Von Kries transformed MacAdam ellipse. The average deviation of the colour coordinates at the end of the endurance test compared with those at the beginning is 0.001 and 0.003, respectively.

FIG. 4 shows that the colour points of lamps not having a protective layer on the enveloping portion differ considerably after completion of the endurance test from those at the beginning of the endurance test. The average deviation of the x- and y-coordinates is 0.017 and 0.010, respectively.

It is clear from the above that lamps corresponding to the embodiment of the invention described with reference to FIG. 2 show only a very small drift in their colour point compared with lamps not corresponding to said embodiment. The average initial value of the colour point (x=375, y=383) differs slightly from the average initial value of the colour point (x=381, y=379) of the lamp not corresponding to said embodiment. This difference in the initial value of the colour point may easily be eliminated by means of a minor change in the composition of the luminescent layer.

We claim:

1. An electrodeless low-pressure discharge lamp comprising a discharge vessel enclosing a gastight discharge space filled with mercury and inert gas, said discharge vessel comprising a light-transmitting enveloping portion and a tubular recessed portion located centrally in said enveloping portion, said enveloping portion and said tubular portion each having a surface facing said discharge space, a coil for generating a high-frequency magnetic field located centrally in said tubular recessed portion, a luminescent layer provided on said surface of said enveloping portion facing said discharge space, and a protective layer of aluminum oxide particles on said luminescent layer, said protective layer having a coating weight of 10 to 50 $\mu g/cm^2$.

* * * * *